US008801217B2

(12) United States Patent
Oehle et al.

(10) Patent No.: US 8,801,217 B2
(45) Date of Patent: Aug. 12, 2014

(54) RECESSED LIGHT HAVING A BASE BODY AND A DOME-SHAPED REFLECTOR

(75) Inventors: Bernd Oehle, Rheda-Wiedenbrück (DE); Stephan Pieper, Lemgo (DE)

(73) Assignee: Zumtobel Lighting GmbH (DE)

( * ) Notice: Subject to any disclaimer, the term of this patent is extended or adjusted under 35 U.S.C. 154(b) by 58 days.

(21) Appl. No.: 13/580,770

(22) PCT Filed: Feb. 23, 2011

(86) PCT No.: PCT/EP2011/052651

§ 371 (c)(1), (2), (4) Date: Nov. 5, 2012

(87) PCT Pub. No.: WO2011/104258

PCT Pub. Date: Sep. 1, 2011

(65) Prior Publication Data

US 2013/0051012 A1 Feb. 28, 2013

(30) Foreign Application Priority Data

Feb. 23, 2010 (DE) ..... 20 2010 002 676 U

(51) Int. Cl.
*F21V 17/06* (2006.01)
*F21V 29/00* (2006.01)

(52) U.S. Cl.
USPC ..... 362/235; 362/296.07; 362/294; 362/310; 362/345; 362/373

(58) Field of Classification Search
None
See application file for complete search history.

(56) References Cited

U.S. PATENT DOCUMENTS

| | | | | |
|---|---|---|---|---|
| 5,826,970 | A | 10/1998 | Keller et al. | |
| 7,478,931 | B2 * | 1/2009 | Miletich et al. | 362/364 |
| 2009/0091938 | A1 * | 4/2009 | Jacobson et al. | 362/362 |
| 2010/0038657 | A1 | 2/2010 | Higuchi et al. | |
| 2011/0096548 | A1 * | 4/2011 | Pickard | 362/294 |

FOREIGN PATENT DOCUMENTS

| | | | |
|---|---|---|---|
| DE | 3249401 | A1 | 10/1984 |
| DE | 9317087 | U1 | 1/1994 |
| DE | 9310757 | U1 | 3/1994 |
| DE | 10013087 | A1 | 9/2001 |
| DE | 102005004868 | A1 | 8/2006 |
| EP | 0750159 | A2 | 12/1996 |
| WO | WO-2008/036873 | A2 | 3/2008 |

OTHER PUBLICATIONS

"International Application No. PCT/EP2011/052651, International Search Report dated Oct. 7, 2011", 10 pgs.
"International Application No. PCT/EP2011/052651, Written Opinion dated Oct. 7, 2011", 20 pgs.

* cited by examiner

*Primary Examiner* — Ashok Patel
(74) *Attorney, Agent, or Firm* — Schwegman, Lundberg & Woessner, P.A.

(57) ABSTRACT

The invention relates to a recessed light having a base body for holding a light source and a dome-shaped reflector which can be detachably fastened to the base body by means of a connecting element. The connecting element is designed such that an optical element for influencing the emission of light is accommodated and fixed when the base body and the reflector are fitted together.

8 Claims, 8 Drawing Sheets

RECESSED LIGHT HAVING A BASE BODY AND A DOME-SHAPED REFLECTOR

PRIORITY CLAIM TO RELATED APPLICATIONS

This application is a national stage application under 35 U.S.C. §371 of PCT/EP2011/052651, filed Feb. 23, 2011, and published as WO 2011/104258 A2 on Sep. 1, 2011, which claims priority to German Application No. 20 2010 002 676.8, filed Feb. 23, 2010, which applications and publication are incorporated by reference as if reproduced herein and made a part hereof in their entirety, and the benefit of priority of each of which is claimed herein.

The present invention relates to a recessed light according to the pre-characterising clause of claim 1, which has a base body for holding a light source and also a dome-shaped reflector which is detachably fastened to the base body via a connecting arrangement. In particular, the present invention relates to a so-called "downlight".

Recessed lights of the type described above are usually used in suspended ceiling systems. They are arranged in a countersunk manner in a circular aperture in the suspended ceiling. Mounting takes place, for example, with the aid of a mounting ring which is first of all fixed to the ceiling. A modular unit consisting of a light-source-carrier and a reflector can then be fastened to the mounting ring. The light emitted by the light source is then essentially emitted vertically downwards via the reflector.

The light emission of the downlight can be influenced in a certain way by the choice and configuration of the reflector. It is also often desired to arrange an optical element inside the reflector or at the light exit aperture of the latter in order to influence the light emission in a certain way. The optical element in question may be a transparent body with light-dispersing or light-refracting properties. The fitting of a spill shield would also be conceivably possible.

DE 100 13 087 A1 by the Applicant describes a downlight which permits the fastening of additional optical components of this kind. For this purpose, a holding ring is provided which is fastened to the outer circumference of a front flange on the reflector. This ring makes it possible to insert an optical element, for example a transparent disc.

The underlying object of the present invention is to indicate a solution for fastening an additional component in the case of a downlight, which solution is an alternative to the known form of embodiment described above.

This object is achieved by means of a recessed light having the features in claim 1. Advantageous further developments of the invention form the subject of the dependent claims.

The recessed light according to the invention also has, first of all, a base body for holding a light source and also a dome-shaped reflector which can be detachably fastened to the base body via a connecting arrangement. According to the invention, however, the connecting arrangement is now constructed in such a way that, when the base body and the reflector are fitted together, an optical element for influencing the light emission is accommodated and fixed in position between the two elements.

In other words, in the case of the present invention, in contrast to the prior art, the optical element is not fastened to the light exit aperture of the reflector but is instead supported between the base body and the reflector. It is fixed in position, for example clamped, at that point when the two elements are fitted together, so that reliable holding is guaranteed. Over and above this, the solution according to the invention would also open up the possibility of additionally arranging further additional components at the light exit aperture of the reflector. On the other hand, the solution which is known from the prior art could be used for this purpose.

The connecting device between the base body and the reflector is preferably constituted by a screw connection or a bayonet connection. This makes it possible to fit the two elements together easily. It is also possible, without any difficulty, to undo the connection in order, for example, to change the optical element.

As the light source, use is preferably made, in the present case, of a light source based on LED's. It may, for example, be a board on which a number of LED's are arranged in a matrix-like manner. In such a case, it must be borne in mind that a not inconsiderable degree of heat is produced when the LED's are functioning. In order to be able to dissipate this effectively, provision is preferably made for the base body itself to constitute a cooling body on which the light source is arranged. In this case, the light source may be arranged, in particular, in a recess in the cooling body, it then being possible to arrange an additional reflector, particularly a pot-like top reflector, in the recess.

The mounting of the recessed light in a ceiling preferably takes place, once again, via a mounting ring which is intended for fastening in the ceiling aperture. The modular unit consisting of the base body and the reflector is then fastened to this mounting ring, for which purpose a screw connection or bayonet connection is preferably provided once again. Under these circumstances, the mounting ring may have latching means for latching or clamping to the ceiling, the said means being preferably provided, in a bearing region, with an element that increases the friction or with a suitable coating. This prevents rotation of the downlight in relation to the ceiling.

The invention will be explained in greater detail below with the aid of the appended drawings, in which:

FIGS. 1 and 2 show views of a first exemplary embodiment of a recessed light according to the invention;

FIG. 3*a* shows a sectional representation of the light in FIGS. 1 and 2;

FIGS. 3*b* and 3*c* show sectional representations of the base body;

Figure 1:
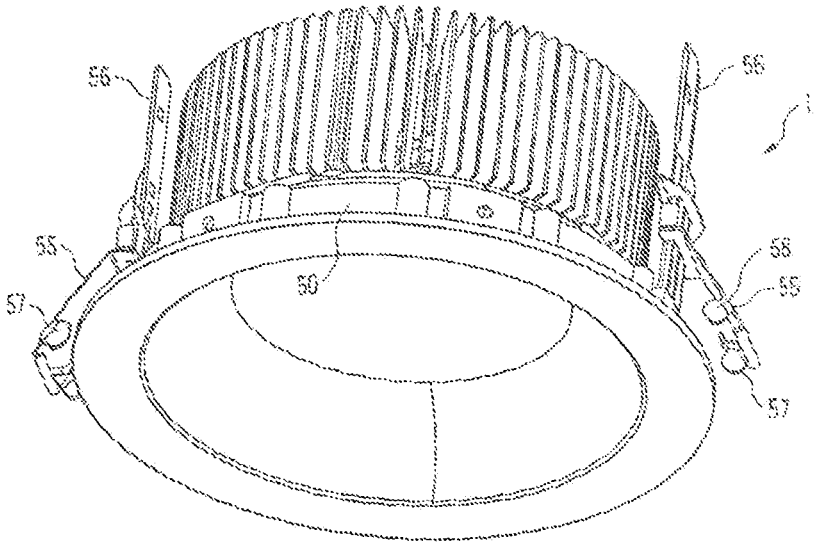
Figure 2:
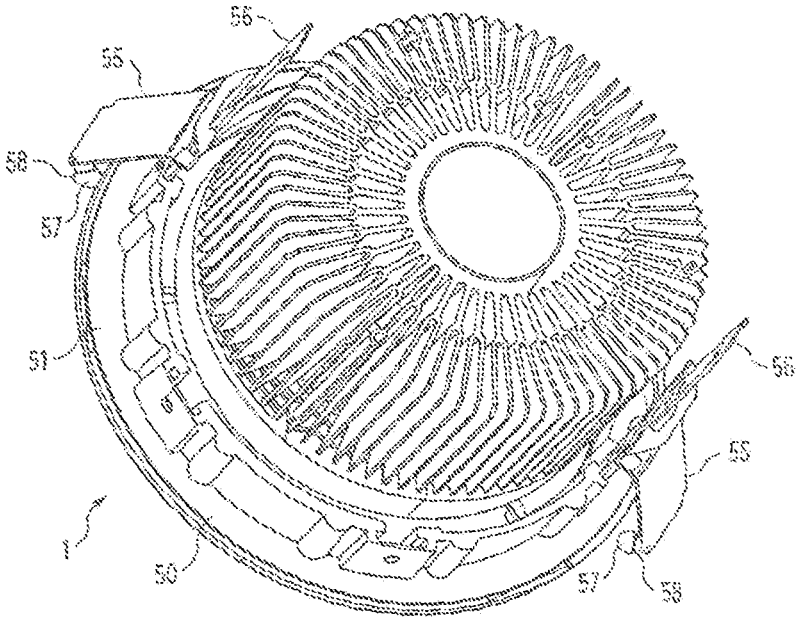
Figure 7A:
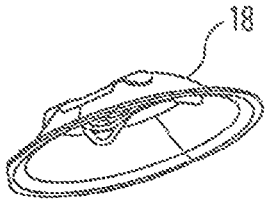
Figure 7B:
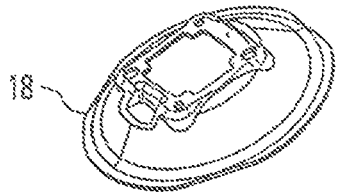
Figure 8A:
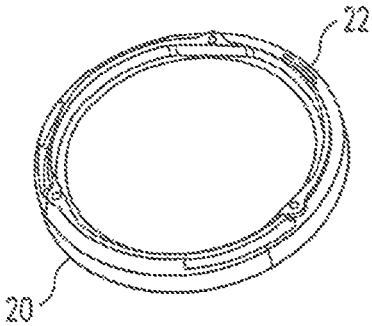
Figure 8B:
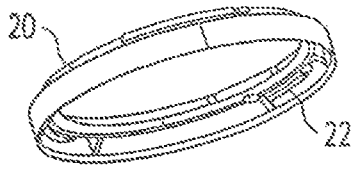
Figure 9A:
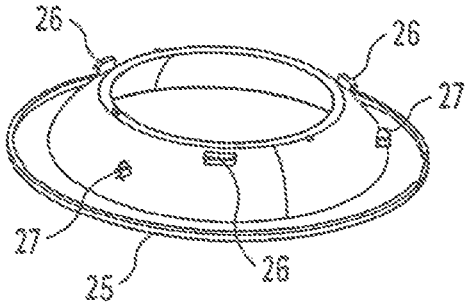
Figure 9B:
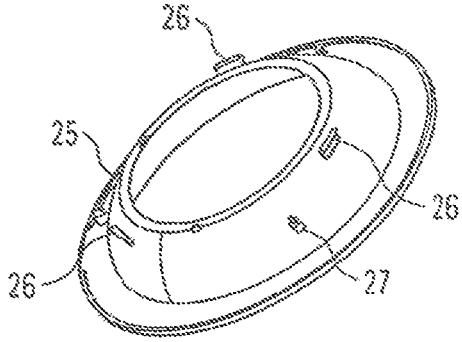
Figure 10A:
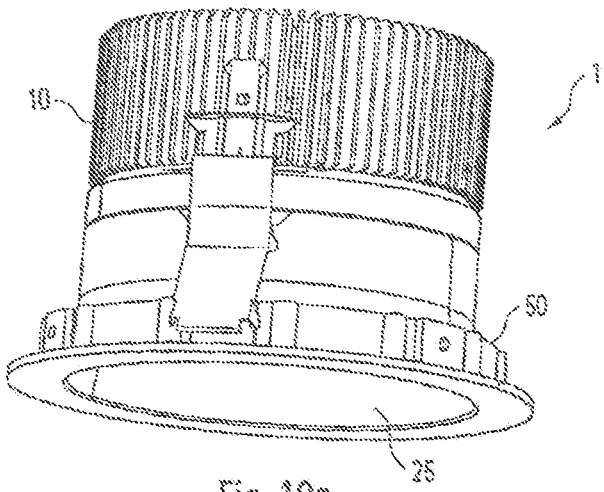
Figure 10B:
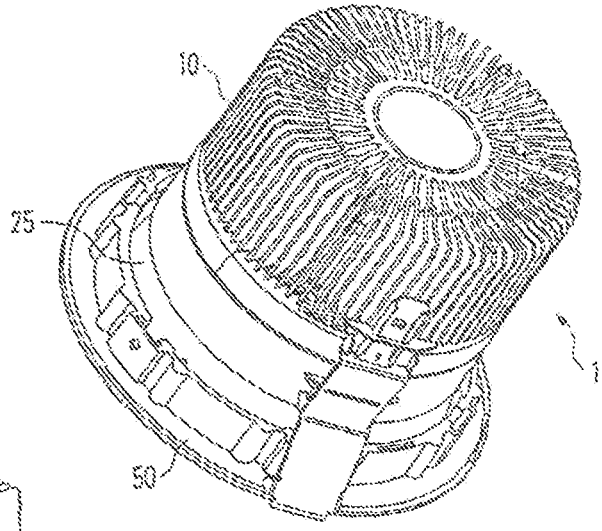
Figure 10C:
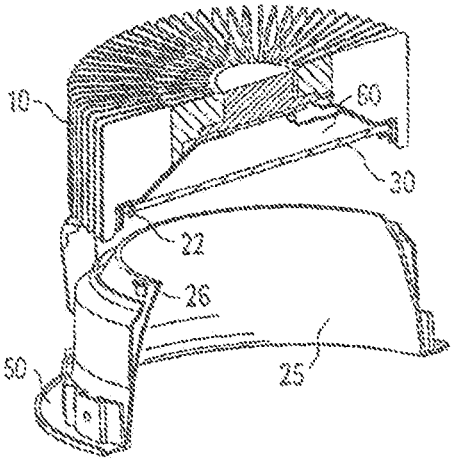
Figure 11A:
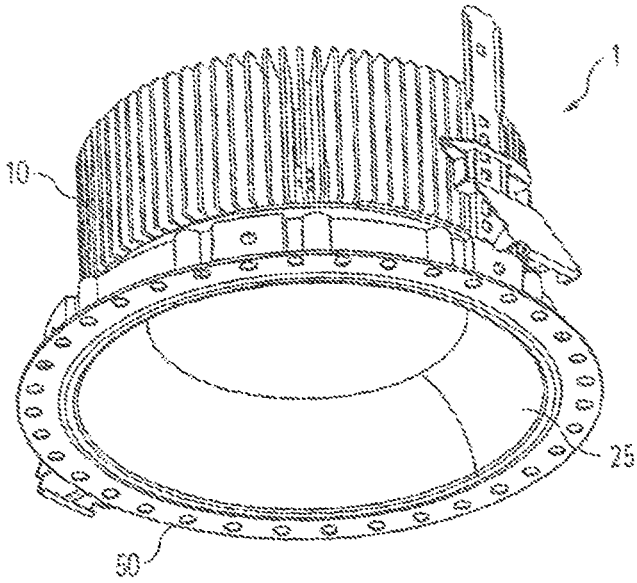
Figure 11B:
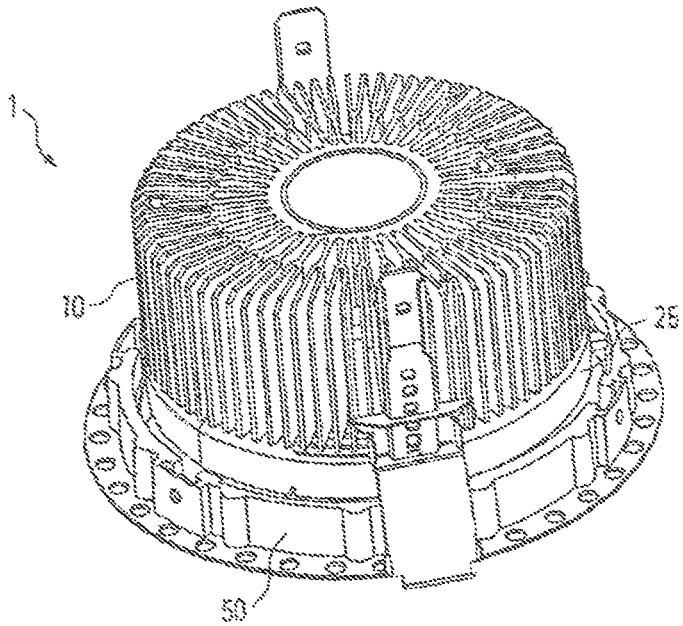
Figure 12A:
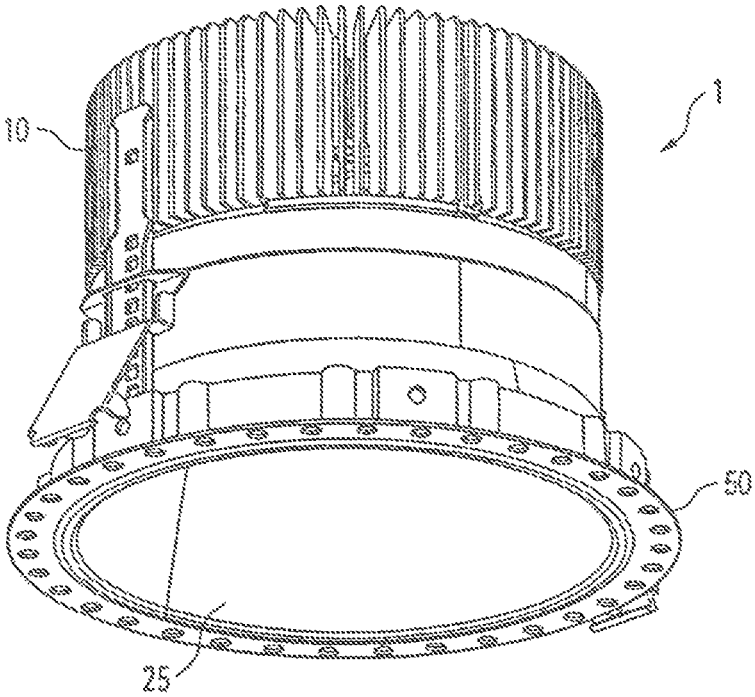
Figure 12B:
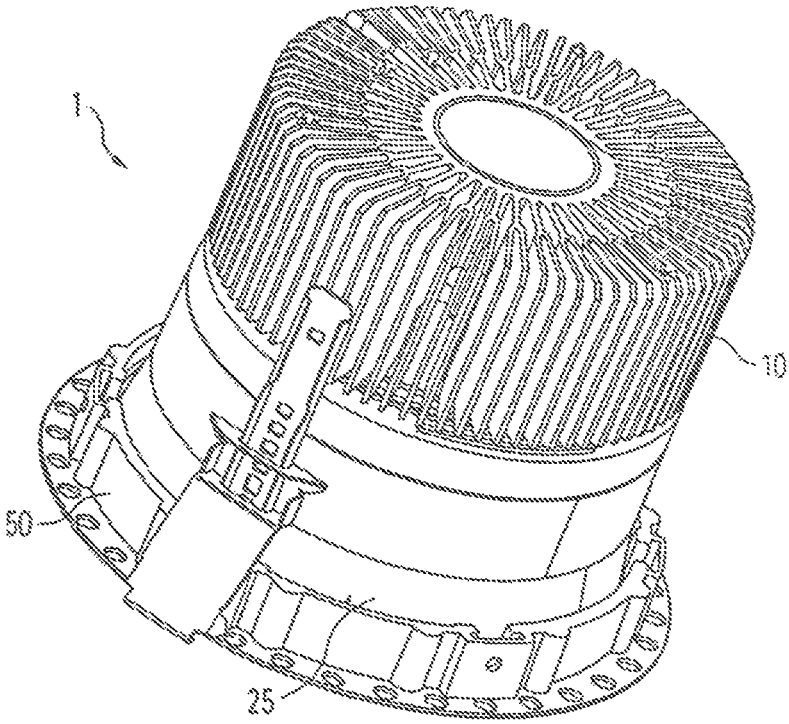

FIGS. 7*a* and 7*b* show views of a top reflector which is used in the light in FIGS. 1 and 2;

FIGS. 8*a* and 8*b* show views of a fastening ring for fastening the dome-shaped reflector to the base body;

FIGS. 9*a* and 9*b* show views of a dome-shaped reflector;

FIGS. 10*a* to 10*c* show views of a second exemplary embodiment of a light according to the invention;

FIGS. 11*a* and 11*b* show views of a third exemplary embodiment of a light according to the invention; and FIGS. 12*a* and 12*b* show views of a fourth exemplary embodiment of a light according to the invention.

FIGS. 1 and 2 show, first of all, views of the recessed light according to the invention, which is provided, as a whole, with the reference symbol 1, in the fully fitted-together condition. The light in question is a so-called "downlight" which is to be mounted in the circular aperture of a suspended ceiling.

In this instance, mounting takes place with the aid of a mounting ring 50 which is first of all fixed to the installation aperture in the ceiling—which is not represented. The actual light unit is then fastened to the mounting ring. This method of mounting downlights is already known and will accordingly not be discussed any further below. It should merely be pointed out, briefly, that the fastening of the mounting ring 50 to the ceiling takes place with the aid of latching means which comprise, in particular, latching arms 55 which are distributed over the circumference of the ring 50 and are arranged in a vertically adjustable manner on webs 56. For the purpose of inserting the mounting ring 50 in the ceiling aperture, the arms 55 are positioned in such a way that they permit the insertion of the mounting ring 50. Outward pivoting of the arms 55 sideways then takes place in such a way that bearing elements 57 rest on the upper side of the suspended ceiling. In conjunction with the circumferential flange 51 resting against the underside of the ceiling, the bearing elements 57 bring about clamping of the mounting ring 50 to the ceiling.

Here a special feature consists, in the present case, in the fact that the bearing elements 57 are provided with an element 58 that increases the friction, or with a coating. The element in question may, for example, be a rubber ring or a suitable slipped-on element made of rubber or plastic, by which the friction with the surface of the ceiling is markedly increased. This prevents unintentional rotation of the mounting ring 50, and ultimately of the light as a whole, in relation to the ceiling.

After the fixing of the mounting ring 50 in the ceiling aperture, the actual light unit is mounted as has already been mentioned. In the present case, this unit consists, on the one hand, of a base body and, on the other, of a dome-shaped reflector. As will be explained again in detail later on, this provides a module-like configuration of the light according to the invention, which makes it possible to use reflectors of different kinds and, furthermore, also easily to utilise optical elements for influencing the light emission.

Figure 4:
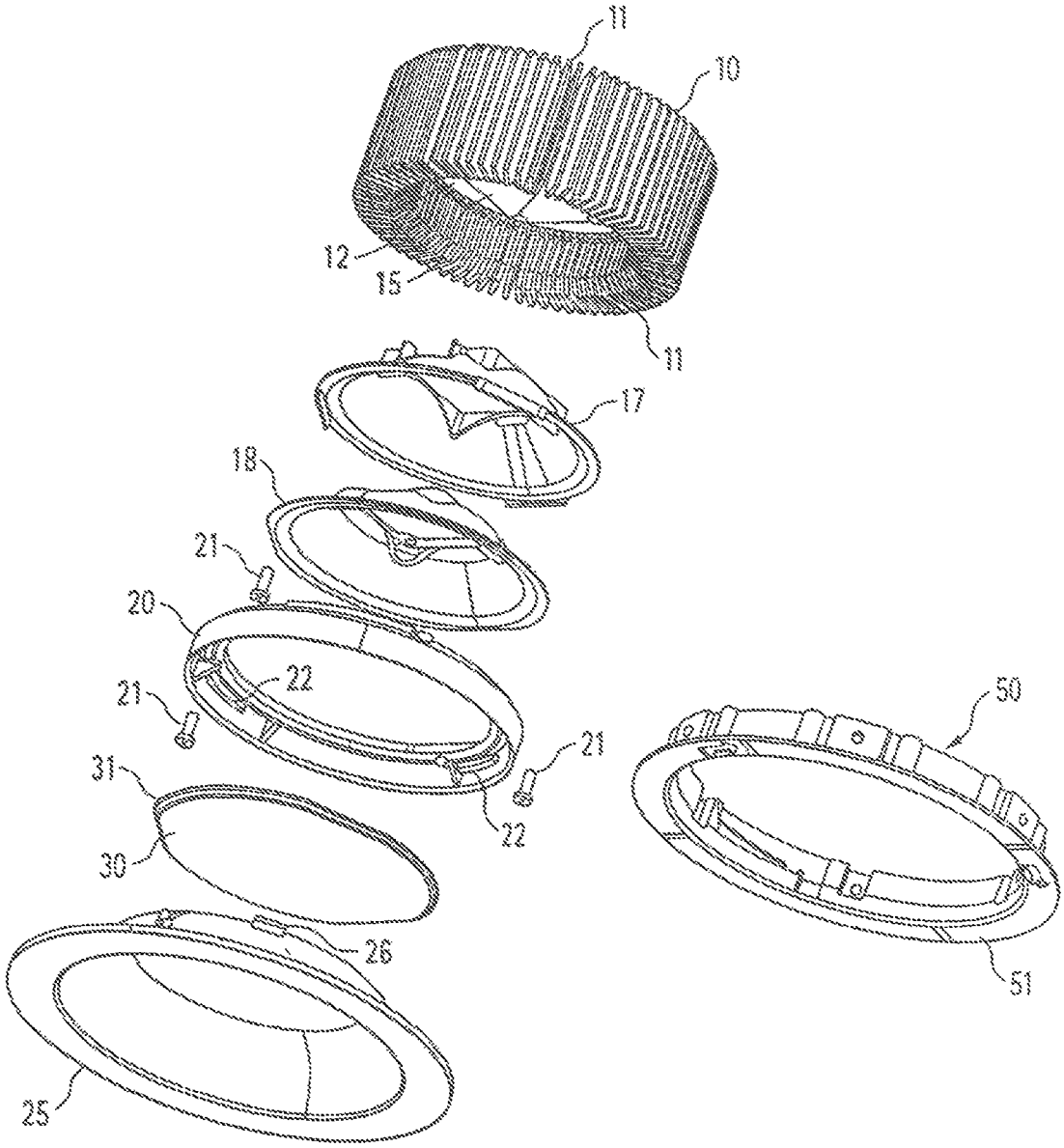
FIG. 4 shows the light according to the first exemplary embodiment, in an exploded representation.

The individual components of these two modular units of the light can also be inferred, in particular, from the exploded representation of FIG. 4.

Here, the base body is constituted by a cylinder-like cooling body 10, which serves, in particular, for holding and cooling the light source. In the present case, the light source is constituted by, in particular, an LED module 15 which has a number of LED's arranged on a board. This board 15 is arranged in a recess in the cooling body 10, and preferably fastened directly on the latter, in order to permit satisfactory transmission of heat. For this purpose, the cooling body 10, which has a large number of cooling fins 11 that extend towards the side from a solid central region 12, is constructed, on one side, with a slightly tapering recess, at the bottom of which is formed the bearing surface for the LED board. Also arranged inside this recess are another dome-shaped plastic element 17 and also a dome-shaped top reflector 18.

The top reflector 18, which is represented in further views in FIGS. 7*a* and 7*b*, here serves to direct the light radiated out by the LED's in a large spatial region effectively towards the underside. This top reflector 18 preferably consists of a relatively flexible plastic material which is deep-drawn into the appropriate shape. The plastic part 17, which is located on the rear side and the shape of which essentially corresponds to the shape of the top reflector 18, here forms a support for the reflector 18.

The two elements, that is to say the plastic part 17 and the top reflector 18, are fixed to the cooling body 10 with the aid of a holding ring 20. The holding ring 20 itself is screwed to the cooling body 10 with the aid of screws 21. FIGS. 8*a* and 8*b* show further views of the said holding ring 20, which is preferably formed from plastic material and which, in the condition in which it is screwed onto the cooling body 10, fixes the plastic part 17 to the top reflector 18 in a clamping manner.

Another essential function of the holding ring 20 consists in providing a detachable connection for the actual dome-shaped reflector 25 of the light 1. A bayonet connection, in particular, between the holding ring 20 and the reflector 25 is provided for this purpose. The reflector, which is represented in greater detail in FIGS. 9*a* and 9*b*, has three hooks 26 on the outside of the reflector wall for this purpose, which hooks form a bayonet connection in conjunction with corresponding guide projections 22 on the holding ring 20. This permits easy and rapid fastening of the reflector 25 to the cooling body 10, although a screw connection would also be conceivably possible as an alternative to this.

Under these circumstances, the connection—that is to say the bayonet connection in the present case—between the holding ring 20 and the reflector 25 is constructed in such a way that optical elements for influencing the light emission can be fitted in and fixed in position when fastening the reflector 25. In the exemplary embodiment represented, the intention is, in particular, to achieve evening-out of the light emission, or the desire is that the individual LED's of the LED board should no longer be individually discernible. To this end, an optical unit, which consists of a plastic disc 30 and also of a light-dispersing film arranged in front of the latter, is to be mounted in the upper region of the reflector 25. The two elements can now—as will be shown below—be placed in the ring 20 before the reflector 25 is fixed to the holding ring 20. If the reflector 25 is then fixed in position by means of the bayonet connection, this also simultaneously leads to fixing of the optical elements 30, 31.

The following mode of procedure now emerges from the above-described interaction of the various components of the light according to the invention, when fitting it together or mounting it.

Figure 5:
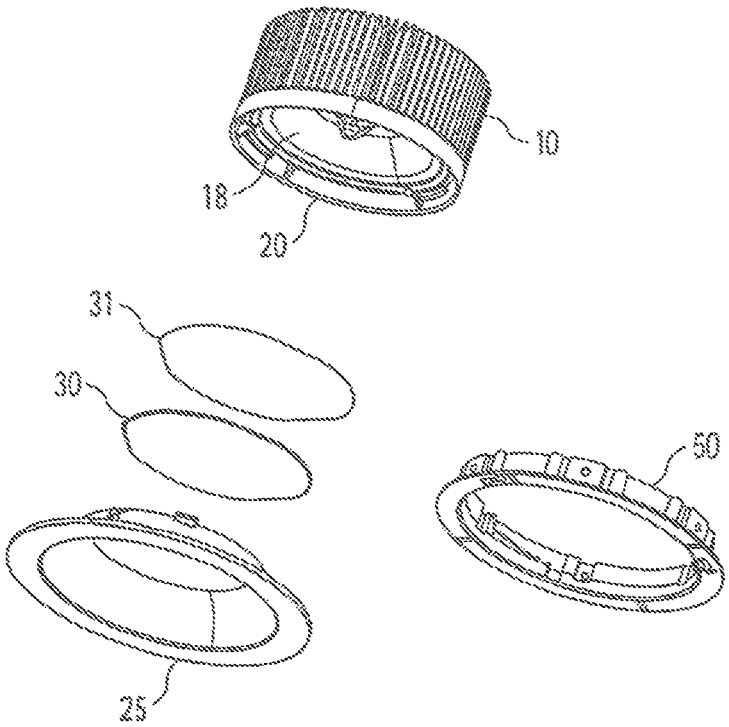
FIGS. 5 and 6 show successive steps in fitting the light together.

The plastic part 17 and the top reflector 18 are first of all placed on the cooling body 10 with the LED module fastened to it. The two elements are then fixed in position with the aid of the holding ring 20, which is screwed onto the cooling body 10 by means of the screws 21, resulting in the arrangement represented in FIG. 5. In the succeeding step, the optical elements, that is to say the dispersing film 31 and the plastic disc 30, are then placed in the holding ring 20. The reflector 25 is then placed on the holding ring 20 and rotated, in order to achieve locking via the bayonet connection.

Figure 6:
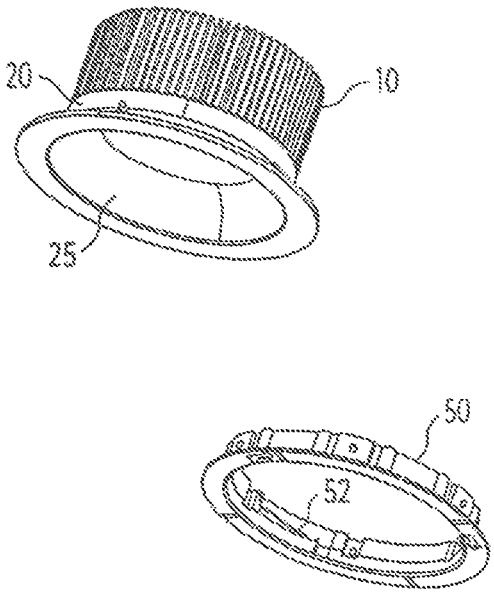

The modular unit which is produced in this instance and is represented in FIG. 6 and which consists of the cooling body 10 and the reflector 25, is then fastened to the mounting ring 50 as has been described at the beginning. Here too, connection again takes place with the aid of a bayonet-type interlocking system, for which purpose the reflector 25 has further protruding lugs 27 on its outside which interact with the corresponding guide tracks 52 on the mounting ring. The reflector 25 therefore constitutes the connecting member between the mounting ring 50 and the cooling body 10.

Figure 3A:
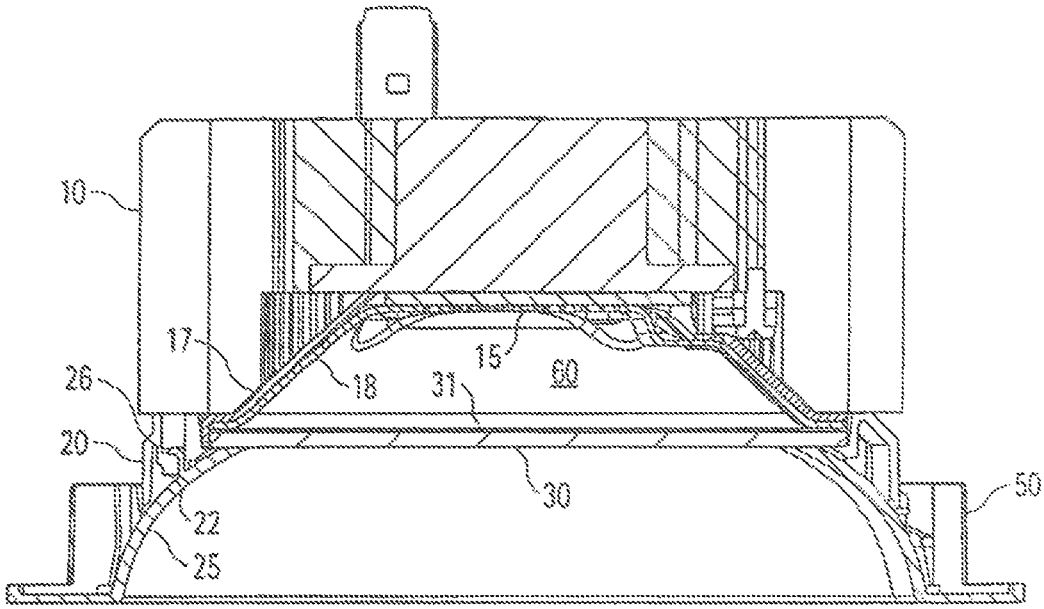
Figure 3B:
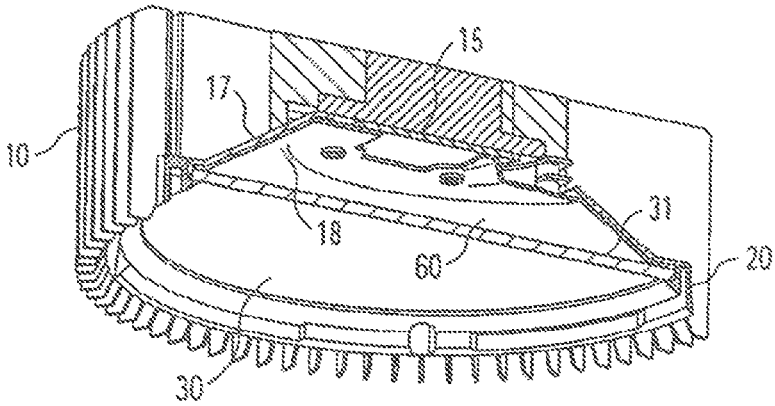
Figure 3C:
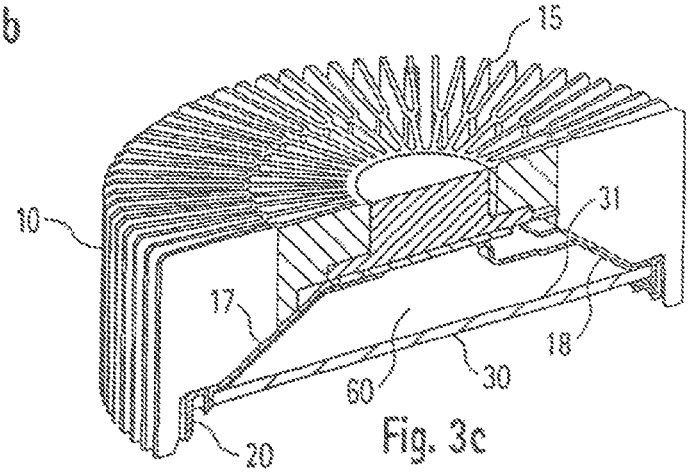

The final result, then, is the arrangement which is shown in perspective views in FIGS. 1 and 2 and in sectional representations in FIGS. 3*a* to 3*c*. Here, it can be clearly seen that the optical elements consisting of the plastic disc 30 and the dispersing film 31 are clamped in between the reflector 25 and the top reflector 18 which is fixed in position with the aid of the holding ring 20. As a result of this, there is formed, in the region between the LED module 15 and the dispersing film 31, a so-called "light chamber" 60 in which intermingling or deflection of the light rays takes place in such a way that a light emission which illuminates as uniformly brightly as possible is achieved. The use of a number of varicoloured LED's for generating light in a specific mixed colour or of a desired colour temperature would be conceivably possible.

The above-described concept according to the invention, namely that of clamping the optical elements for influencing the light emission in between the top reflector and the dome-type reflector, is not restricted to the disc-like optical elements represented. It would also be conceivably possible, for example, to install spill shields or comparable elements in a suitable manner. Moreover, in the case of disc-like elements, light-influencing elements with prismatic structures or the like might also be used.

Furthermore, the modular mode of construction of the light according to the invention opens up the possibility of carrying out the changing of the reflector in a simple manner. In FIGS. 10 to 12, further exemplary embodiments of the recessed lights according to the invention, in which use has been made of different reflectors in each case, are represented on an exemplary basis. The Figures show that it is possible to influence the appearance of the light and also its light emission by changing the reflectors. Thus, in the variants in FIGS. 10*a* to 10*c*, the reflector has a higher configuration, which results in a more intensively clustered light emission towards the underside. The variants in FIGS. 11 and 12 correspond to the first and second exemplary embodiments; in these cases, however, the reflector 25 does not have a circumferential frame on the underside. In this so-called "frameless" variant, the mounting ring is also of somewhat different design, since it is now either plastered after being mounted or is fastened to the ceiling from the upper side.

However, the fitting-together and mounting of the lamp takes place in the same way in all the examples, so that it is possible, in the end, to produce recessed lights with different configurations. In all these variants, the advantage described above remains, namely the possibility of being able to easily install optical elements for influencing the light emission.

The invention claimed is:

1. A recessed light, said recessed light comprising:

a base body for holding a light source;

a dome-shaped reflector that is detachably fastened to the base body via a connecting arrangement; and a mounting ring for fastening in a ceiling aperture, wherein the connecting arrangement is constructed in such a way that an optical element for influencing the light emission is accommodated and fixed in position when the base body and the reflector are fitted together, and wherein the mounting ring has latching means for latching or clamping to the ceiling, the said latching means being provided, in a bearing region, with an element that increases the friction or with a coating.

2. The recessed light according to claim 1, wherein the connecting arrangement is constituted by a screw connection or a bayonet connection.

3. The recessed light according to claim 1, wherein the base body is a cooling body on which the light source is arranged.

4. The recessed light according to claim 3, wherein the light source is arranged in a recess in the cooling body, a pot-like top reflector also being arranged in the recess.

5. The recessed light according to claim 1, wherein the optical element is constituted by a dispersing disc or dispersing film.

6. The recessed light according to claim 1, wherein the optical element is constituted by a spill shield.

7. The recessed light according to claim 1, wherein the reflector is detachably connected to the mounting ring via a screw connection or a bayonet connection.

8. The recessed light according to claim 1, wherein the light source has one or more LED's.

* * * * *